US010207163B2

(12) United States Patent
Mizutani

(10) Patent No.: US 10,207,163 B2
(45) Date of Patent: Feb. 19, 2019

(54) GOLF CLUB HEAD

(71) Applicant: DUNLOP SPORTS CO. LTD., Kobe-shi, Hyogo (JP)

(72) Inventor: Naruhiro Mizutani, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/628,174

(22) Filed: Jun. 20, 2017

(65) Prior Publication Data

US 2018/0001158 A1 Jan. 4, 2018

(30) Foreign Application Priority Data

Jun. 30, 2016 (JP) ..... 2016-130219

(51) Int. Cl.
*A63B 53/08* (2015.01)
*A63B 53/04* (2015.01)

(52) U.S. Cl.
CPC ..... *A63B 53/047* (2013.01); *A63B 53/0466* (2013.01); *A63B 53/04* (2013.01); *A63B 53/08* (2013.01); *A63B 2053/042* (2013.01); *A63B 2053/0408* (2013.01); *A63B 2053/0412* (2013.01); *A63B 2053/0416* (2013.01); *A63B 2053/0425* (2013.01); *A63B 2053/0429* (2013.01); *A63B 2053/0433* (2013.01); *A63B 2053/0458* (2013.01); *A63B 2053/0462* (2013.01)

(58) Field of Classification Search
CPC ..... A63B 53/04; A63B 53/0466; A63B 53/08; A63B 2053/0416; A63B 2053/042; A63B 2053/0425; A63B 2053/0429
USPC ..... 473/342, 343, 345
See application file for complete search history.

(56) References Cited

U.S. PATENT DOCUMENTS 8,690,702 B2 * 4/2014 Abe ..... A63B 53/0466 473/316
8,956,246 B2 * 2/2015 Myrhum ..... A63B 53/0466 473/342
2010/0234135 A1 9/2010 Matsunaga

* cited by examiner

*Primary Examiner* — Benjamin Layno
(74) *Attorney, Agent, or Firm* — Birch, Stewart, Kolasch & Birch, LLP

(57) ABSTRACT

A head 2 includes a face part 4. The face part 4 includes a plurality of constant thickness regions S1 and S2, and a plurality of thickness transition regions R1, R2 and R3. The constant thickness regions include a first constant region S1 and a second constant region S2 which is thinner than the first thickness region S1. The thickness transition regions R1, R2 and R3 which are adjacent to each other is disposed between the first constant region S1 and the second constant region S2. The thickness transition regions adjacent to each other have different thickness change rates from each other.

19 Claims, 6 Drawing Sheets

GOLF CLUB HEAD

The present application claims priority on Patent Application No. 2016-130219 filed in JAPAN on Jun. 30, 2016, the entire contents of which are hereby incorporated by reference.

BACKGROUND OF THE INVENTION

Field of the Invention

The present invention relates to a golf club head.

Description of the Related Art

A wood type, an iron type, and a utility type, for example, are known as golf club heads. Any types of golf club heads include a face part. The face part is a portion whose outer surface is a hitting surface.

US2010/0234135 discloses a wood type golf club head in which the face part includes a first region, a second region and an inclination portion. The first region has a maximum thickness, the second region has a minimum thickness, and the inclination portion is disposed between the first region and the second region.

SUMMARY OF THE INVENTION

It is preferable to increase deflection in order to enhance rebound performance. In this respect, a face part is preferably made thin. Meanwhile, in light of durability, the face part is preferably made thick. It is difficult to enlarge a high restitution zone while enhancing durability.

The present disclosure provides a golf club head having a large high-restitution zone and high durability of the face part.

In one aspect, the golf club head may include a face part. The face part may include a plurality of constant thickness regions and a plurality of thickness transition regions. The constant thickness regions may include a first constant region and a second constant region that is thinner than the first constant region. The thickness transition regions adjacent to each other may be disposed between the first constant region and the second constant region. Thickness change rates of the thickness transition regions adjacent to each other may be different from each other.

In another aspect, the thickness transition regions may have a thickness decreasing toward the second constant region from the first constant region.

In another aspect, the first constant region may be a thickest region of the constant thickness regions.

In another aspect, the first constant region may include a face center.

The first constant region has a thickness that is defined as TS1 (mm), and the second constant region has a thickness that is defined as TS2 (mm). In another aspect, TS2/TS1 may be equal to or less than 0.6.

The first constant region has an area that is defined as MS1 ($mm^2$), the second constant region has an area that is defined as MS2 ($mm^2$), and a face surface that forms an outer surface of the face part has an entire area that is defined as Mf1 ($mm^2$). In another aspect, MS1/Mf1 may be equal to or less than 0.20. In another aspect, MS2/Mf1 may be equal to or greater than 0.08.

The face part has a weight that is defined as Wf1 (g), and the face surface that forms the outer surface of the face part has the entire area that is defined as Mf1 ($mm^2$). In another aspect, Wf1/Mf1 may be equal to or less than 0.0112 ($g/mm^2$).

In another aspect, the face part may be formed by a composite material. In this case, Wf1/Mf1 may be equal to or less than 0.0105 ($g/mm^2$).

DESCRIPTION OF THE PREFERRED EMBODIMENTS

The present disclosure will be described later in detail based on preferred embodiments with appropriate reference to the drawings.

Figure 1:
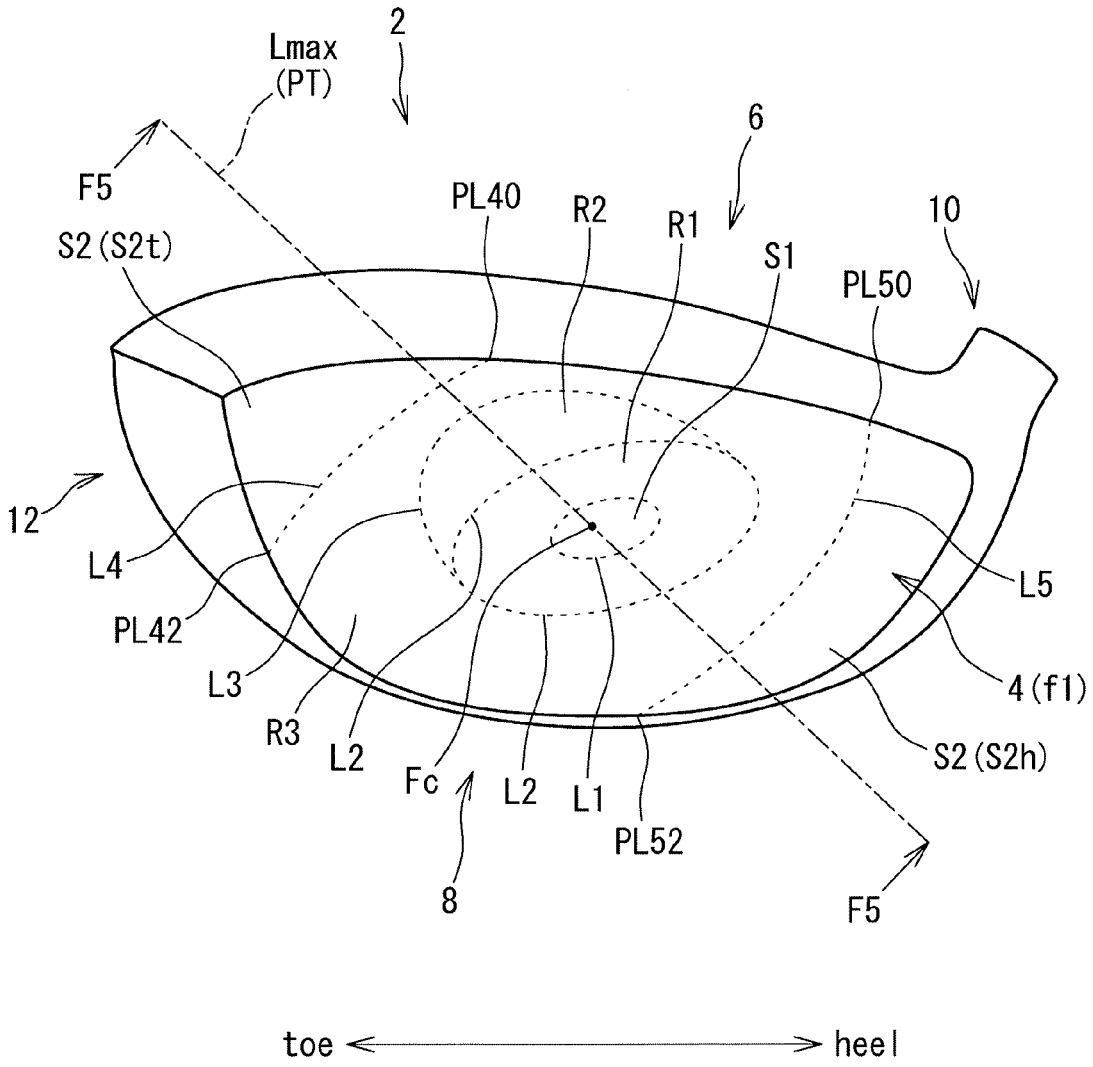
FIG. 1 is a front view of a golf club head according to a first embodiment.

FIG. 1 shows a golf club head 2 according to a first embodiment. The head 2 includes a face part 4, a crown part 6, a sole part 8 and a hosel part 10. The head 2 further includes a side part 12. The side part 12 is also referred to as a skirt part. The side part 12 extends between the crown part 6 and the sole part 8. The face part 4 has an outer surface that is a face surface f1 (hitting face). Although score line grooves are provided on the face surface f1, the description of the score line grooves is omitted.

The face surface f1 is a carved surface outwardly projected. The face surface f1 includes a face bulge and a face roll. The head 2 is a wood type golf club head. The head 2 is a driver head (number 1 wood).

The head 2 is a hollow head. An inner surface (not shown in the drawings) of the face part 4 is referred to as a face reverse surface. The face reverse surface faces the hollow part of the head 2.

[Definition of Terms]

The terms in the present application are defined as follows.

[Reference State]

Figure 6:
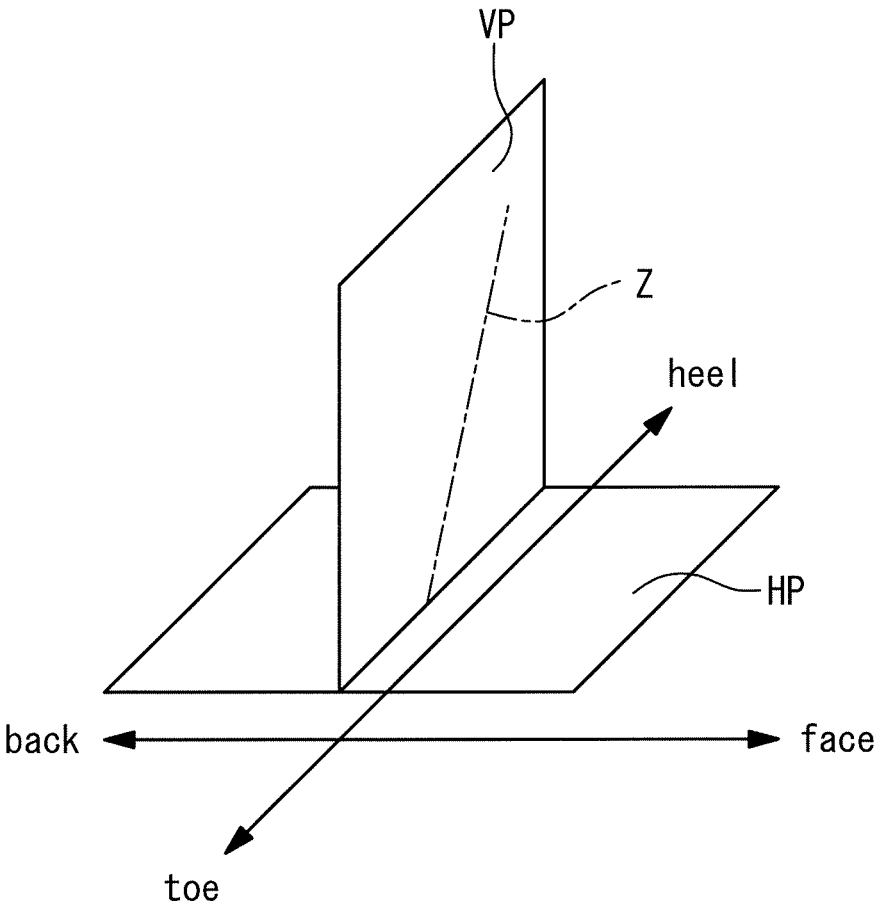
FIG. 6 is a perspective view for illustrating a reference state.

A reference state is defined as a state in which the head is placed on a horizontal plane HP at a specified lie angle and real loft angle. In the reference state, the center axis line Z (shaft axis line z) of a shaft hole of the head is included in a reference perpendicular plane VP (see FIG. 6). The reference perpendicular plane VP is a plane perpendicular to the horizontal plane HP. The specified lie angle and loft angle are described in product catalogs, for example.

[Toe-Heel Direction]

In the head of the reference state, the toe-heel direction is defined as the direction of an intersection line of the reference perpendicular plane VP and the horizontal plane HP.

[Face-Back Direction]

The face-back direction is defined as a direction perpendicular to the toe-heel direction and parallel with the horizontal plane HP. The face-back direction is also a front-back direction. A face side is also referred to as a front side.

[Vertical Direction]

The vertical direction is defined as a direction perpendicular to the toe-heel direction and perpendicular to the face-back direction.

[Face Center Fc]

First, in the vertical direction and the toe-heel direction, an optional point Pr that is approximately located near the middle of the face surface is selected. Next, a plane is determined, which passes through the point Pr, extends along the normal direction of the face surface at the point Pr, and is parallel to the toe-heel direction. An intersectional line between the plane and the face surface is drawn, and a middle point Px of the intersectional line is determined. Next, a plane is determined, which passes through the middle point Px, extends along the normal direction of the face surface at the point Px, and is parallel to the vertical direction. An intersectional line between the plane and the face surface is drawn, and a middle point Py of the intersectional line is determined. Next, a plane is determined, which passes through the middle point Py, extends along the normal direction of the face surface at the point Py, and is parallel to the toe-heel direction. An intersectional line between the plane and the face surface is drawn, and a middle point Px of the intersectional line is newly determined. Next, a plane is determined, which passes through the new middle point Px, extends along the normal direction of the face surface at the point Px, and is parallel to the vertical direction. An intersectional line between the plane and the face surface is drawn, and a middle point Py of the intersectional line is newly determined. The process is repeated to sequentially determine Px and Py. The new position Py (last position Py) when a distance between the new middle point Py and the middle point Py immediately before the new middle point Py is first equal to or less than 1 mm during the repetition of the process is the face center Fc.

[Face Projection View]

A plan view in which the face surface f1 is viewed from the front is referred to as a face projection view. The face projection view is a projection view obtained by projecting the face surface f1 to a specific plane. The direction of the projection is the direction of the normal line of the face surface flat the face center Fc. The specific plane is a plane perpendicular to the normal line.

[Application of Face Projection View]

Areas described in the present application, such as areas MS1, MS2, Mf1 as shown below, are measured on the face projection view. Shapes of regions shown below (such as an elliptical shape) is a shape on the face projection view. Similarly, matters regarding positions and shapes of regions (such as a central point, the major axis and the minor axis of an ellipse, the center of figure, relationship between regions) are also determined in the face projection view.

[Thickness of Face Part 4]

A thickness of the face part 4 is measured along the normal direction of the face surface f1. The thickness of the face part 4 is also referred to as a face thickness or simply a thickness. If the face surface f1 is a curved surface, the normal direction of the face surface f1 might vary according to the position of the face surface f1. A face thickness at a point is measured along the normal direction of the face surface f1 at the point.

[Face Contour]

A face contour is determined in order to determine an entire area Mf1, and the like, of the face surface. In the determination of the contour, countless planes which pass through the face center Fc and is parallel to the face-back direction are considered. These planes are countless planes radially extending from the face center Fc. These planes are also referred to as radial sections. A curvature radius of the head outer surface is confirmed in each of the radial sections. The curvature radii are confirmed in order from the face center Fc toward face outside, and a first point having a curvature radius of equal to or less than 200 mm is determined. This point is defined as a point that constitutes the face contour.

However, there is a portion in which the contour cannot be determined by the above described method. Some heads include a portion, in the vicinity of the hosel part 10, by which a heel upper portion of the face surface f1 is connected to the cylindrical portion of the hosel part 10 so that they are almost flush with each other. In this portion, the contour of the face surface f1 cannot be determined by the above method, and as a result, the contour is interrupted. The interruption of the contour can be resolved by a complemental treatment as shown below.

Figure 2:
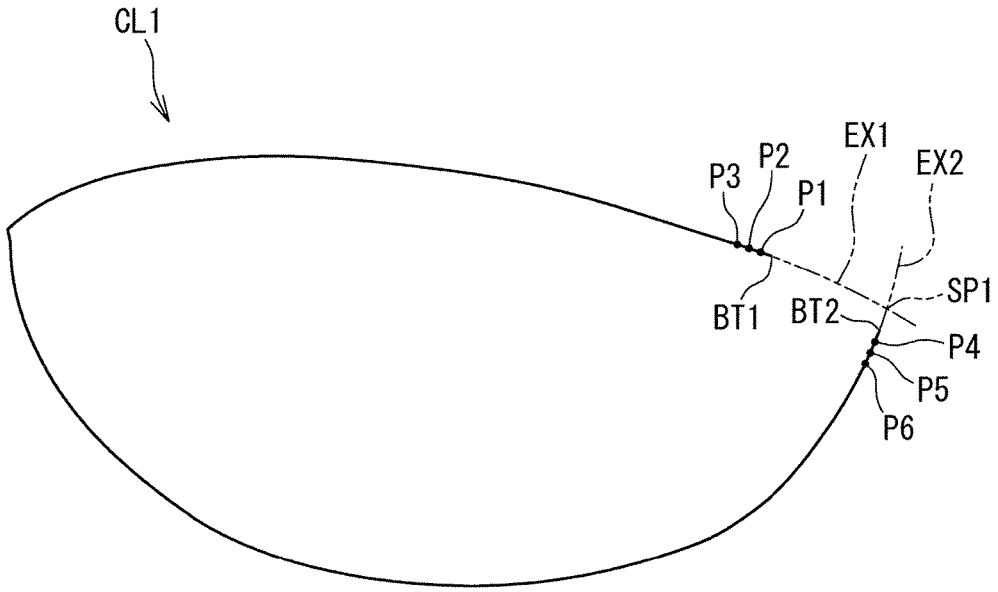
FIG. 2 is an illustrative view of a method for determining a face contour.

FIG. 2 is an illustrative view of the complemental treatment. In the complemental treatment, first, the contour having an interruption, which is obtained by the above method, is projected to a plane to obtain a contour CL1 on the face projection view. As discussed above, the direction of the projection is the normal direction of the face surface f1 at the face center Fc, and the projection surface is the specific plane.

In the face projection view, extension lines are drawn from respective two interruption ends BT1 and BT2. An extension line EX1 is drawn from the interruption end BT1. The extension line EX1 is a circular arc passing through three points P1, P2 and P3 on the contour. The point P1 is a point 1 mm distant from the interruption end BT1. The point P2 is a point 2 mm distant from the interruption end BT1. The point P3 is a point 3 mm distant from the interruption end BT1. Similarly, an extension line EX2 is drawn from the interruption end BT2. The extension line EX2 is a circular arc passing through three points P4, P5 and P6 on the contour. The point P4 is a point 1 mm distant from the interruption end BT2. The point P5 is a point 2 mm distant from the interruption end BT2. The point P6 is a point 3 mm distant from the interruption end BT2.

Then, an intersection point SP1 between the extension lines EX1 and EX2 is determined. Of the extension line EX1, a portion between the interruption end BT1 and the intersection point SP1 is a first complemental line. Of the extension line EX2, a portion between the interruption end BT2 and the intersection point SP1 is a second complemental line. A complemented face contour is completed by adding the first and the second complemental lines to the interrupted contour. Although the number of the complemental lines is two in the present embodiment, the number of the complemental lines may properly be one.

[Weight Wf1 of Face Part]

In the determination of a weight Wf1 of the face part, the face contour is determined on the surface of the head. However, when the complemental treatment is performed, the complemental lines drawn on the face projection view is reversely projected to the surface of the head. The direction of the reverse projection is also the normal direction of the face surface f1 at the face center Fc. The head is cut along the face contour. The direction of the cutting is a direction parallel to the face-back direction. The face part is cut out by the cutting. The weight of the cutout face part is defined as the weight Wf1. If a non-face part which is obviously not the face part is cut out together with the face part, the non-face part is removed to determine the weight Wf1.

Back in FIG. 1, a dashed line in FIG. 1 shows divisional lines for dividing regions of the face part 4. These divisional lines are determined based on a thickness distribution of the face part 4. The divisional lines can correspond to a ridgeline or a valley line formed on the reverse surface of the face part 4. However, even when the reverse surface of the face is seen, the divisional lines may not be visually recognized.

The face part 4 includes a first constant region S1 and the second constant region S2 as a plurality of constant thickness regions. The first constant region S1 is disposed on a central portion of the face part 4. The first constant region S1 includes the face center Fc. The second constant region S2 is disposed apart from the first constant region S1. The second constant region S2 is disposed on a peripheral part of the face part 4. A part of the contour of the second constant region S2 is the face contour.

In the present embodiment, two kinds (three portions) of the constant thickness regions are provided. Three kinds or more of the constant-thickness regions may be provided. The constant thickness regions may be provided on three or more portions. An excessively complicated thickness distribution can increase the costs of the mold and the like. In this respect, the number of kinds of the constant thickness regions is preferably equal to or less than 3. Because of the same reason, the number of portions of the constant thickness regions is preferably equal to or less than 4, and more preferably equal to or less than 3. In light of optimizing the thickness distribution, the number of portions of the constant thickness regions is preferably equal to or greater than 2. The kinds of constant thickness regions are determined by thickness thereof. When their thicknesses are the same, their kinds are considered as the same.

In the constant thickness region, the range of thickness within ±0.05 mm is regarded as permissible deviation.

The second constant region S2 includes a toe-side constant region S2*t* and a heel-side constant region S2*h*. In the present embodiment, the face thickness of the toe-side constant region S2*t* is equal to the face thickness of the heel-side constant region S2*h*.

The toe-side constant region S2*t* is positioned on a toe side relative to the first constant region S1. A part of the contour of the toe-side constant region S2*t* is a boundary line between the crown part 6 and the face part 4. A part of the contour of the toe-side constant region S2*t* is a boundary line between the side part 12 and the face part 4. The contours of the toe-side constant region S2*t* are constituted of the face contour and a toe contour L4. The contour of the toe-side constant region S2*t* does not include the boundary line between the sole part 8 and the face part 4. The contour of the toe-side constant region S2*t* may include the boundary line between the sole part 8 and the face part 4.

The heel-side constant region S2*h* is positioned on a heel side relative to the first constant region S1. A part of the contour of the heel-side constant region S2*h* is the boundary line between the crown part 6 and the face part 4. A part of the contour of the heel-side constant region S2*h* is the boundary line between the side part 12 and the face part 4. A part of the contour of the heel-side constant region S2*h* is the boundary line between the sole part 8 and the face part 4. The contours of the heel-side constant region S2*h* are constituted of the face contour and a heel contour L5.

The center of figure of the toe-side constant region S2*t* is position on an upper relative to the center of figure of the heel-side constant region S2*h*. The center of figure of the toe-side constant region S2*t* is position on an upper side relative to the face center Fc. The center of figure of the heel-side constant region S2*h* is position on a lower side relative to the face center Fc.

In the present application, the constant thickness regions include the first constant region and the second constant region that is thinner than the first constant region. The first constant region may be a region having a greatest thickness (thickest part) of the constant thickness regions. The second constant region may be a region having a smallest thickness (thinnest part) of the constant thickness regions. In the present embodiment, the first constant region S1 is the thickest part and the second constant region S2 is the thinnest part.

The constant thickness regions may include three kinds of thickness regions. That is, the constant thickness regions may include the thickest part, a medium-thickness part that is thinner than the thickest part, and the thinnest part that is thinner than the medium-thickness part. The constant thickness regions may further include four or more kinds of thickness regions. As long as a relationship in which the second constant region is thinner than the first constant region is satisfied, any region may be set to the first constant region and any region may be set to the second constant region.

The head 2 includes the first constant region S1. The first constant region S1 includes the face center Fc. The head 2 includes the second constant region S2. The second constant region S2 includes the toe-side constant region S2*t* and the heel-side constant region S2*h*.

An area MS1 of the first constant region S1 is not limited. The first constant region S1 may be a point.

The face part 4 includes the first transition region R1, the second transition region R2 and the third transition region R3 as the thickness transition regions. The first transition region R1 is adjacent to the first constant region S1. The first transition region R1 is disposed around the first constant region S1. A contour L1 on the inside of the first transition region R1 is also the contour of the first constant region S1. The contour L1 has an elliptical shape. The contour L1 may not be an elliptical shape.

An elliptical shape described in the present application is a concept including the range of ±10% deviation with respect to a true ellipse. As to a true ellipse A, an ellipse B having +10% of the major axis and +10% of the minor axis of the ellipse A, and an ellipse C having −10% of the major axis and −10% of the minor axis of the ellipse A can be determined. An almost elliptical shape which can be fitted between the ellipse B and the ellipse C is defined as an elliptical shape. In this case, the center of the almost elliptical shape fitted between the ellipse B and the ellipse C is considered as the center of the ellipse A. Similarly, in this case, the major axis and the minor axis of the almost elliptical shape fitted between the ellipse B and the ellipse C is considered as the major axis and the minor axis of the ellipse A.

A contour L2 on the outside of the first transition region R1 is the elliptical shape. The contour L2 is concentric with the contour L1. In the present application, if a distance between central points of two elliptical shapes is equal to or less than 1 mm, it is considered that the two elliptical shapes are concentric with each other. The contour L2 may not be the elliptical shape.

Directions of major axes of the contour L2 and the contour L1 coincide with each other. In the present application, when an angle between two major axes is equal to or less than 3 degrees, it is considered that the directions of the major axes coincide with each other. Directions of minor axes of the contour L2 and the contour L1 coincide with each other. In the present application, if an angle between two minor axes is equal to or less than 3 degrees, it is considered that the directions of the minor axes coincide with each other.

The major axis of the contour L1 having an elliptical shape is inclined to an upper side toward the heel side. The major axis of the contour L2 having an elliptical shape is inclined to an upper side toward the heel side.

Such an inclination of the elliptical shape can contribute to forming a high restitution area corresponding to a normal distribution of hitting points.

The length of the major axis of the contour L1 is defined as A1 and the length of the minor axis of the contour L1 is defined as B1. In light of effectively enhancing strength with a minimum thick part, A1/B1 should fall within a predetermined range. That is, as the lower limit, A1/B1 is preferably equal to or greater than 1.01, more preferably equal to or greater than 1.05, and still more preferably equal to or greater than 1.1. As the upper limit, A1/B1 is preferably equal to or less than 3, more preferably equal to or less than 2.5, and still more preferably equal to or less than 2.

The length of the major axis of the contour L2 is defined as A2, and the length of the minor axis of the contour L2 is defined as B2. In light of effectively enhancing strength with a minimum first transition region R1, A2/B2 preferably falls within a predetermined range. That is, as the lower limit, A2/B2 is preferably equal to or greater than 1.01, more preferably equal to or greater than 1.05, and still more preferably equal to or greater than 1.1. As the upper limit, A2/B2 is preferably equal to or less than 2.8, more preferably equal to or less than 2.4, and still more preferably equal to or less than 2.0.

The second transition region R2 is adjacent to the first transition region R1. A part of the contour of the second transition region R2 is the contour L2 on the outside of the first transition region R1. The contours of the second transition region R2 are constituted of the contour L2 and the contour L3. The contour L3 is a curved line projecting toward a toe-upper side. Both ends of the contour L3 are positioned on the contour L2.

The second transition region R2 is positioned on the toe side and the upper side of the first transition region R1. The center of figure of the second transition region R2 is position on the upper side relative to the face center Fc. The center of figure of the second transition region R2 is positioned on the toe side relative to the face center Fc.

The center of figure of the second transition region R2 is positioned on the upper side relative to the center of the contour L1 (elliptical shape). The center of figure of the second transition region R2 is positioned on the toe side relative to the center of the contour L1 (elliptical shape). The center of figure of the second transition region R2 is positioned on the upper side relative to the center of contour L2 (elliptical shape). The center of figure of the second transition region R2 is positioned on the toe side relative to the center of the contour L2 (elliptical shape).

The second transition region R2 disposed in these manners can contribute to improvement in durability of the face part 4, since the normal distribution of hitting points is considered.

The third transition region R3 is disposed around a region consisting of the first transition region R1 and the second transition region R2. An inside contour of third transition region R3 is the contour L2 and the contour L3. A part of an outside contour of the third transition region R3 is the boundary line between the face part 4 and the crown part 6. A part of the outside contour of the third transition region R3 is the boundary line between the face part 4 and the sole part 8.

A part of the outside contour of the third transition region R3 is a toe contour L4. The toe contour L4 is the boundary line between the third transition region R3 and the toe-side constant region S2*t*. The toe contour L4 is inclined to a lower side toward the toe side. The toe contour L4 is curved to project toward toe-upper side (toward outside of the face surface f1). A heel side (upper side) end of the toe contour L4 is positioned on the boundary line between the face part 4 and the crown part 6. A toe side (lower side) end of the toe contour L4 is positioned on the boundary line between the face part 4 and the side part 12. The whole toe contour L4 is positioned on the toe side relative to the face center Fc.

A part of the outside contour of the third transition region R3 is the heel contour L5. The heel contour L5 is the boundary line between the third transition region R3 and the heel-side constant region S2*h*. The heel contour L5 is inclined to a lower side toward the toe side. The heel contour L5 is curved to project toward a heel-lower side (toward outside of the face surface f1). A heel side (upper side) end of the heel contour L5 is positioned on the boundary line between face part 4 and the crown part 6. A toe side (lower side) end of the heel contour L5 is positioned on the boundary line between the face part 4 and the sole part 8. The whole heel contour L5 is positioned on the heel side relative to the face center Fc.

A point PL40 at the most heel side of the toe contour L4 is positioned on the toe side relative to a point PL52 at the most toe side of the heel contour L5. A point PL 42 at the lowermost side of the toe contour L4 is positioned on the upper side relative to a point PL52 at the lowermost side of the heel contour L5. A point PL40 at the uppermost side of the toe contour L4 is positioned on an upper side relative to a point PL50 at the uppermost side of the heel contour L5.

The toe-side constant region S2*t* and the heel-side constant region S2*h* disposed in these manners contribute to formation of a high restitution area corresponding to the normal distribution of hitting points.

In the first transition region R1, the face thickness gradually varies. In a portion positioned between the first constant region S1 and the second transition region R2, the thickness of the first transition region R1 gradually decreases toward the second transition region R2 from the first constant region S1. In a portion positioned between the first constant region S1 and the third transition region R3, the thickness of the first transition region R1 gradually decreases toward the third transition region R3 from the first constant region S1.

In the second transition region R2, the face thickness gradually varies. The thickness of the second transition region R2 gradually decreases toward the third transition region R3 from the first transition region R1.

In the third transition region R3, the face thickness gradually varies. In a portion positioned between the second transition region R2 and the toe-side constant region S2*t*, the thickness of the third transition region R3 gradually decreases toward the toe-side constant region S2*t* from the second transition region R2. In a portion positioned between the first transition region R1 and the heel-side constant region S2*h*, the thickness of the third transition region R3 gradually decreases toward the heel-side constant region S2*h* from the first transition region R1.

Thus, in all of the transition regions R1, R2 and R3, the face thickness decreased toward the periphery of the face part 4 from the first constant region S1. Thus, in all of the transition regions, the face thickness preferably decreases toward the periphery of the face part 4 from the first constant region S1.

A level difference step does not exist on the contour L1. A level difference step does not exist on the contour L2. A level difference step does not exist on the contour L3. A level difference step does not exist on the contour L4. A level difference step does not exist on the contour L5. The reverse surface of the face part 4 has no level difference step. The whole reverse surface of the face part 4 is continuous with no level difference step. A stress concentration caused by a level difference step is prevented in the face part 4.

Figure 3:
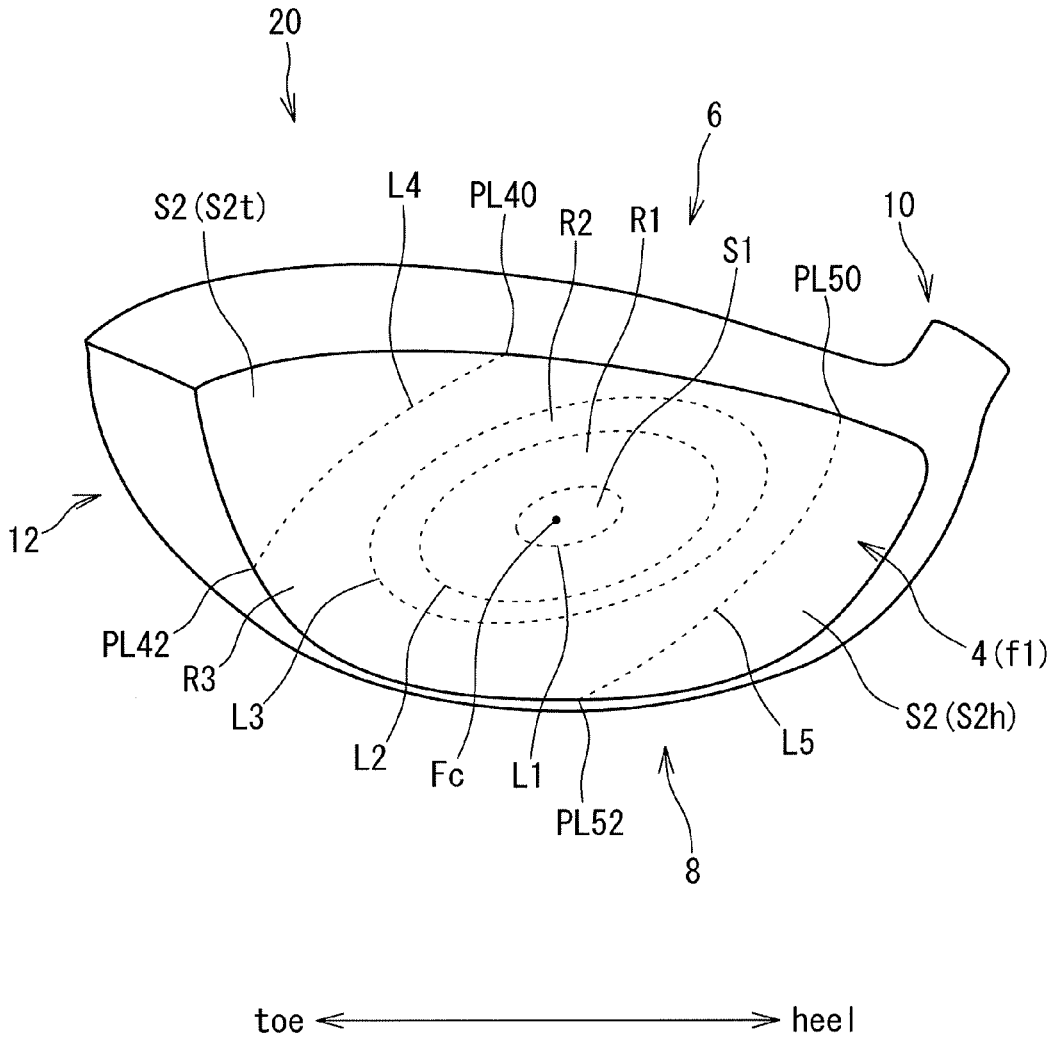
FIG. 3 is a front view of a golf club head according to a second embodiment.

FIG. 3 shows a golf club head 20 according to a second embodiment. The head 20 includes a face part 4, a crown part 6, a sole part 8 and a hosel part 10. The head 20 further includes a side part 12. The side part 12 extends between the crown part 6 and the sole part 8. The face part 4 has an outer surface that is a face surface f1 (hitting face). Although score line grooves are provided on the face surface f1, the score line grooves are not shown in the drawing.

The face surface f1 is a curved surface outwardly projected. The face surface f1 includes a face bulge and a face roll. The head 20 is a wood type golf club head. The head 20 is a driver head (number 1 wood).

The head 20 is a hollow head. The inner surface (not shown in the drawing) of the face part 4 is also referred to as a face reverse surface. The face reverse surface faces a hollow part of the head 20.

Dashed lines in FIG. 3 show divisional lines dividing regions on the face part 4. These divisional lines are determined based on the thickness distribution of the face part 4. These divisional lines can correspond to a ridgeline or a valley line formed on the reverse surface of the face part 4.

The face part 4 includes a first constant region S1 and a second constant region S2 as a plurality of constant thickness regions. The first constant region S1 is disposed on a central portion of the face part 4. The first constant region S1 includes the face center Fc. The second constant region S2 is disposed apart from the first constant region S1. The second constant region S2 is disposed on a peripheral part of the face part 4. A part of the contour of the second constant region S2 is a face contour.

The second constant region S2 includes a toe-side constant region S2*t* and a heel-side constant region S2*h*.

The toe-side constant region S2*t* is positioned on a toe side relative to the first constant region S1. A part of the contour of the toe-side constant region S2*t* is the boundary line between the crown part 6 and the face part 4. A part of the contour of the toe-side constant region S2*t* is the boundary line between the side part 12 and the face part 4. The contour of the toe-side constant region S2*t* does not include a boundary line between the sole part 8 and the face part 4.

The heel-side constant region S2*h* is positioned on a heel side relative to the first constant region S1. A part of the contour of the heel-side constant region S2*h* is the boundary line between the crown part 6 and the face part 4. A part of the contour of the heel-side constant region S2*h* is the boundary line between the side part 12 and the face part 4. A part of the contour of the heel-side constant region S2*h* is the boundary line between the sole part 8 and the face part 4.

A center of figure of the toe-side constant region S2*t* is positioned on an upper side relative to a center of figure of the heel-side constant region S2*h*. The center of figure of the toe-side constant region S2*t* is positioned on an upper side relative to the face center Fc. The center of figure of the heel-side constant region S2*h* is positioned on a lower side relative to the face center Fc.

The first constant region S1 is the thickest part. The first constant region S1 includes the face center Fc. The second constant region S2 is the thinnest part. The second constant region S2 includes the toe-side constant region S2*t* and the heel-side constant region S2*h*.

The face part 4 includes a first transition region R1, a second transition region R2 and a third transition region R3 as a plurality of thickness transition regions. The first transition region R1 is adjacent to the first constant region S1. The first transition region R1 is disposed around the first constant region S1. A contour L1 on the inside of the first transition region R1 is also a contour of the first constant region S1. The contour L1 has an elliptical shape. The contour L1 may not be an elliptical shape.

A contour L2 on the outside of the first transition region R1 has an elliptical shape. The contour L2 is concentric with the contour L1. Directions of the major axes of the contour L2 and the contour L1 coincide with each other. Directions of the minor axes of the contour L2 and the contour L1 coincide with each other. The contour L2 may not be an elliptical shape.

The second transition region R2 is adjacent to the first transition region R1. A contour on the inside of the second transition region R2 is the contour L2 on the outside of the first transition region R1. The second transition region R2 is deposed around the first transition region R1. A contour on the outside of the second transition region R2 is a contour L3. The contours of the second transition region R2 are constituted of the contour L2 and the contour L3. The contour L3 has an elliptical shape. The contour L3 may not be an elliptical shape.

The contour L3 is concentric with the contour L2. Directions of major axes of the contour L3 and the contour L2 coincide with each other. Directions of minor axes of the contour L3 and the contour L2 coincide with each other.

Consequently, the contour L3 is concentric with the contour L1 and the contour L2. Directions of the major axes of the contour L3, the contour L2 and the contour L1 coincide with each other. Directions of the minor axes of the contour L3, the contour L2 and the contour L1 coincide with each other.

The major axis of the contour L1 that has an elliptical shape is inclined to an upper side toward the heel side. The major axis of the contour L2 that has an elliptical shape is inclined to an upper side toward the heel side. The major axis of the contour L3 that has an elliptical shape is inclined to an upper side toward the heel side.

Such inclinations of the elliptical shapes can contribute to formation of high restitution area that corresponds to the normal distribution of hitting points.

A length of the major axis of the contour L3 is defined as A3 and a length of the minor axis of the contour L3 is defined as B3. In light of effectively enhancing strength with a minimum second transition region R2, A3/B3 preferably falls within a predetermined range. That is, A3/B3 is preferably equal to or greater than 1.01, more preferably equal to or greater than 1.05, and still more preferably equal to or greater than 1.1 as the lower limit, but preferably equal to or less than 2.8, more preferably equal to or less than 2.4, and still more preferably equal to or less than 2.0 as the upper limit.

The third transition region R3 is disposed around the second transition region R2. The inner contour of the third transition region R3 is the contour L3. A part of an outer contour of the third transition region R3 is the boundary line between the face part 4 and the crown part 6. A part of the outer contour of the third transition region R3 is the boundary line between the face part 4 and the sole part 8.

A part of the outer contour of the third transition region R3 is a toe contour L4. The toe contour L4 is the boundary line between the third transition region R3 and the toe-side constant region S2*t*. The toe contour L4 is inclined to a lower side toward the toe side. The toe contour L4 is curved to project toward the toe-upper side (toward outside of the face surface f1). A heel side (upper side) end of the toe contour L4 is positioned on the boundary line between the face part 4 and the crown part 6. A toe side (lower side) end of the toe contour L4 is positioned on the boundary line between the face part 4 and the side part 12. The whole toe contour L4 is positioned on the toe side relative to the face center Fc.

A part of the outer contour of the third transition region R3 is a heel contour L5. The heel contour L5 is the boundary line between the third transition region R3 and the heel-side constant region S2*h*. The heel contour L5 is inclined to a lower side toward the toe side. The heel contour L5 is curved to project toward a heel-lower side (toward outside of the face surface f1). A heel side (upper side) end of the heel contour L5 is positioned on the boundary line between the face part 4 and the crown part 6. A toe side (lower side) end of the heel contour L5 is positioned on the boundary line between the face part 4 and the sole part 8. The whole heel contour L5 is positioned on the heel side relative to the face center Fc.

A point PL40 on the most heel side of the toe contour L4 is positioned on the toe side relative to a point PL52 on the most toe side of the heel contour L5. A point PL42 at the lowermost side of the toe contour L4 is positioned on the upper side relative to a point PL52 of the lowermost side of the heel contour L5. A point PL40 at the uppermost side of the toe contour L4 is positioned on the upper side relative to the uppermost side of the heel contour L5.

In the first transition region R1, the face thickness gradually varies. The thickness of the first transition region R1 gradually decreases toward the second transition region R2 from the first constant region S1.

In the second transition region R2, the face thickness gradually varies. The thickness of the second transition region R2 gradually decreases toward the third transition region R3 from the first transition region R1.

In the third transition region R3, the face thickness gradually varies. In a portion positioned between the second transition region R2 and the toe-side constant region S2*t*, the thickness of the third transition region R3 gradually decreases toward the toe-side constant region S2*t* from the second transition region R2. In a portion positioned between the second transition region R2 and the heel-side constant region S2*h*, the thickness of the third transition region R3 gradually decreases toward the heel-side constant region S2*h* from the second transition region R2.

Thus, thickness of the transition regions R1, R2 and R3 gradually decreases toward the periphery of the face part 4 from the first constant region S1. The thickness of the transition regions R1, R2 and R3 gradually decreases toward the second constant region S2 from the first constant region S1.

A level difference step does not exist on the contour L1. A level difference step does not exist on the contour L2. A level difference step does not exist on the contour L3. A level difference step does not exist on the contour L4. A level difference step does not exist on the contour L5. The reverse surface of the face part 4 has no level difference step. The whole reverse surface of the face part 4 is continuous without a level difference step. A stress concentration caused by a level difference step is prevented in the face part 4.

In the above described first and second embodiments, in all of the transition regions R1, R2 and R3, the face thickness decreases toward the periphery of the face part 4 from the first constant region S1. In any one of the transition regions, the face thickness may increase toward the periphery of the face part 4 from the first constant region S1.

In the above described first and second embodiments, the thickness transition regions are disposed to be adjacent to each other. The thickness transition regions have different thickness change rates from each other.

[Thickness Change Rate]

For each of the aforementioned radial sections, an intersection line between the radial section and the specific plane can be determined. A distance (mm) in the direction (direction of the specific intersection line) along the intersection line is set to an x-axis. The face thickness (mm) is set to a y-axis. An x-y plane constituted of the x-axis and the y-axis is defined. A gradient of a graph on the x-y plane is defined as a thickness change rate.

Figure 4:
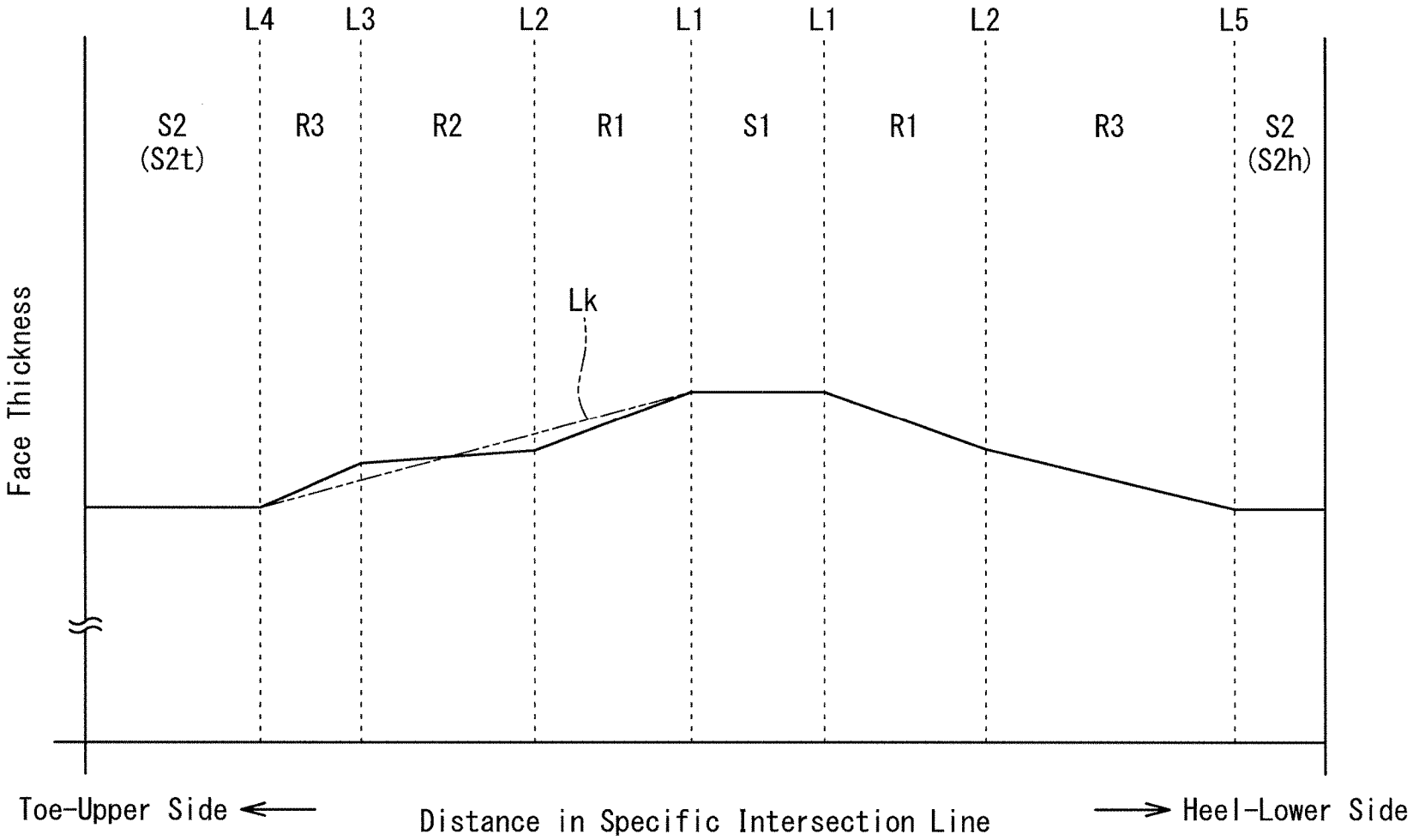
FIG. 4 is a graph showing a schema of a thickness distribution in the first embodiment.

FIG. 4 shows an example of the x-y plane. FIG. 1 shows a traversal line Lmax passing through the face center Fc and having a distance across the second transition region R2 which is the longest. In FIG. 4, a cross section along the traversal line Lmax is adopted as an example of the radial section. That is, the graph of FIG. 4 shows a thickness distribution in which a plane PT, which is along the traversal line Lmax and is in the face-back direction, is set to the cross section. In view of easiness of seeing, in the graph of FIG. 4, dimensions of the x-axis and y-axis do not coincide with each other.

As shown in FIG. 4, in the toe side of the first constant region S1, the thickness change rate (inclination angle) of the third transition region R3 is greater than the thickness change rate of the second transition region R2. In the toe side of the first constant region S1, the thickness change rate of the first transition region R1 is greater than the thickness change rate of the second transition region R2. In the heel side of the first constant region S1, the thickness change rate of the first transition region R1 is greater than the thickness change rate of the third transition region R3.

As shown in the graph of FIG. 4, in the toe side of the first constant region S1, the second transition region R2 is disposed to be adjacent to the outside of the first transition region R1, and the third transition region R3 is disposed to be adjacent to the outside of the second transition region R2. In the toe side of the first constant region S1, the thickness change rate (inclination angle) in the third transition region R3 is greater than the thickness change rate of the second transition region R2. In the toe side of the first constant region S1, the thickness change rate of the first transition region R1 is greater than the thickness change rate of the second transition region R2.

As shown in the graph of FIG. 4, in the heel side of the first constant region S1, the second transition region R2 is not present, and the third transition region R3 is disposed to be adjacent to the outside of the first transition region R1. In the heel side of the first constant region S1, the thickness change rate of the first transition region R1 is greater than the thickness change rate of the third transition region R3.

A two-dot chain line in FIG. 4 shows a virtual thickness line Lk in which a thickness change rate between the first constant region S1 and the second constant region S2 (toe-side constant region S2*t*) is constant. The thickness change rate of the first transition region R1 is greater than the thickness change rate of the virtual thickness line Lk. The thickness change rate of the second transition region R2 is smaller than the thickness change rate of the virtual thickness line Lk. The thickness change rate of the third transition region R3 is greater than the thickness change rate of the virtual thickness line Lk. A thickness on the boundary line (contour L2) between the first transition region R1 and the second transition region R2 is smaller than the thickness of the virtual thickness line Lk on the boundary line. A thickness on the boundary line (contour L3) between the second transition region R2 and the third transition region R3 is greater than the thickness of the virtual thickness line Lk on the boundary line.

In the embodiment of FIG. 4, the thickness on the contour L2 is smaller than the thickness of the virtual thickness line Lk on the contour L2. This thinness enhances rebound performance. In the first transition region R1, the thickness gradually varies without a level difference step thereby to maintain durability of the face part 4.

In the second transition region R2, since the thickness change rate is suppressed, deterioration of durability caused by a steep change of the thickness is suppressed. Thus, the durability of the face part 4 is maintained.

In the third transition region R3, since the thickness gradually varies without a level difference step to maintain durability. Furthermore, since the third transition region R3 has a greater thickness change rate as compared with that of the virtual thickness line Lk, the thickness of the toe contour L4 is suppressed while securing the thickness of the contour L3 and maintaining durability, and thereby to enlarge the high restitution area.

Figure 5:
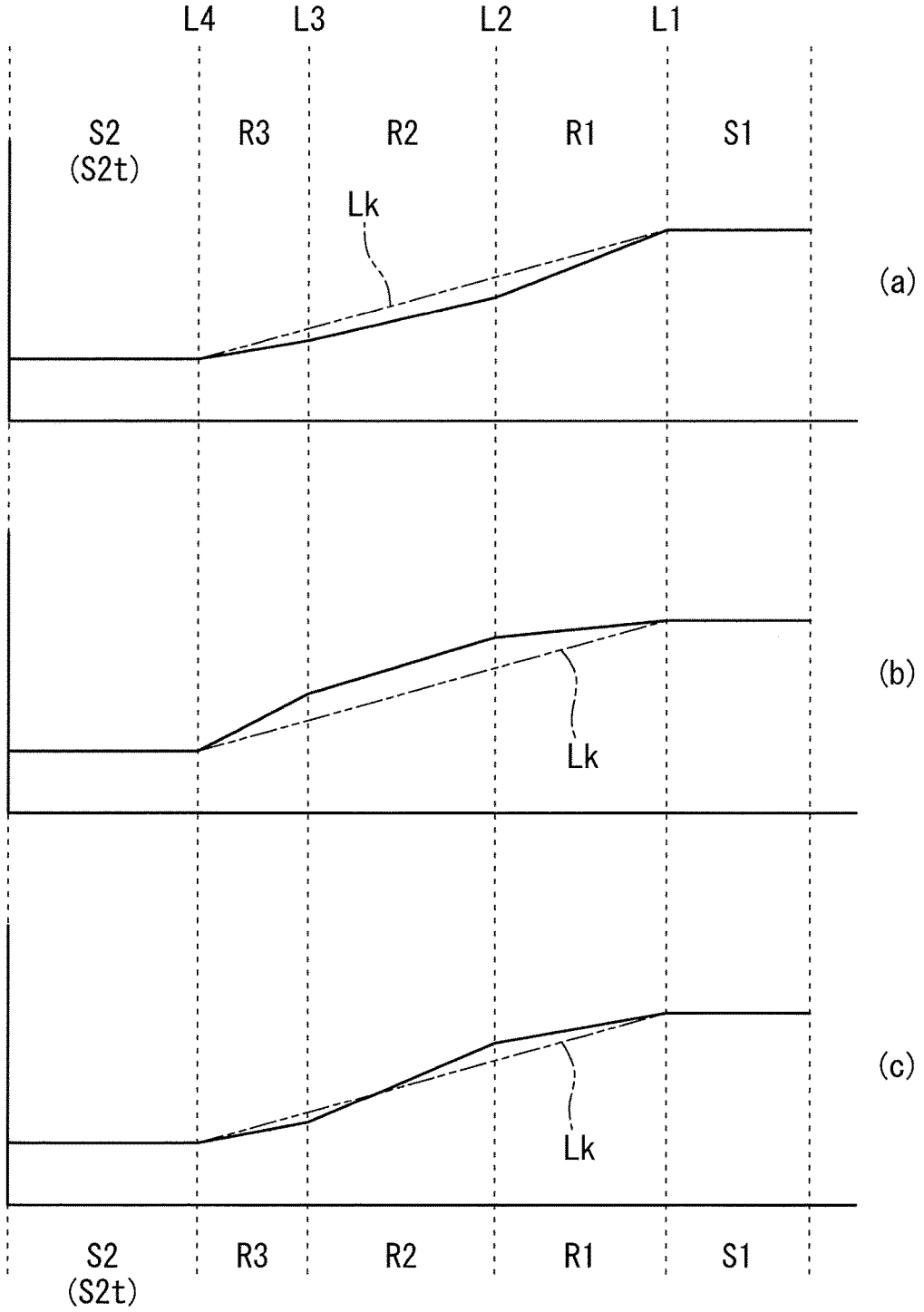
FIG. 5 is graphs showing modified embodiments of the thickness distribution.

Symbols (a), (b) and (c) in FIG. 5 show thickness distributions of modified examples. FIG. 5 also shows thickness distributions of the cross section that is the plane PT.

In the embodiment of the symbol (a) in FIG. 5, the thickness change rate of the first transition region R1 is greater than the thickness change rate of the virtual thickness line Lk. The thickness change rate of the second transition region R2 is smaller than the thickness change rate of the virtual thickness line Lk. The thickness change rate of the third transition region R3 is smaller than the thickness change rate of the virtual thickness line Lk. The thickness on the boundary line (contour L2) between the first transition region R1 and the second transition region R2 is smaller than the thickness of the virtual thickness line Lk on the boundary line. The thickness on the boundary line (contour L3) between the second transition region R2 and the third transition region R3 is smaller than the thickness of the virtual thickness line Lk on the boundary line.

In the symbol (a) in FIG. 5, since the thickness in the transition regions is thin on the whole, the high restitution area can be enlarged. In addition, since the thicknesses of the transition regions gently vary overall, the durability can be maintained. Furthermore, since a steep change in thickness is suppressed, rebound performance can be stably attained.

In the embodiment of the symbol (b) in FIG. 5, the thickness change rate in the first transition region R1 is smaller than the thickness change rate of the virtual thickness line Lk. The thickness change rate in the second transition region R2 is greater than the thickness change rate of the virtual thickness line Lk. The thickness change rate of the third transition region R3 is greater than the thickness change rate of the virtual thickness line Lk. The thickness on the boundary line (contour L2) between the first transition region R1 and the second transition region R2 is greater than the thickness of the virtual thickness line Lk on the boundary line. The thickness on the boundary line (contour L3) between the second transition region R2 and the third transition region R3 is greater than the thickness of the virtual thickness line Lk on the boundary line.

In the symbol (b) in FIG. 5, since the thicknesses of the transition regions are thick on the whole, the durability is excellent. In addition, since the thicknesses gently decrease in the overall transition regions, a steep change in thickness is suppressed, and rebound performance is stably exhibited.

In the embodiment of symbol (c) in FIG. 5, the thickness change rate of the first transition region R1 is smaller than the thickness change rate of the virtual thickness line Lk. The thickness change rate of the second transition region R2 is greater than the thickness change rate of the virtual thickness line Lk. The thickness change rate of the third transition region R3 is smaller than the thickness change rate of the virtual thickness line Lk. The thickness on the boundary line (contour L2) between the first transition region R1 and the second transition region R2 is greater than the thickness of the virtual thickness line Lk on the boundary line. The thickness on the boundary line (contour L3) between the second transition region R2 and the third transition region R3 is smaller than the thickness of the virtual thickness line Lk on the boundary line.

In the symbol (c) in FIG. 5, since a region close to the first constant region S1 is relatively thick, it is excellent in durability. Since a region relatively far from the first constant region S1 is relatively thin, the high restitution area can be enlarged. Since the thickness gently decreases, it is also excellent in durability.

Deformation of the face part in hitting is complicated. In light of enhancing the durability of the face part while enlarging the high restitution area, it has been found that setting a more detailed thickness distribution is necessary. As a result of diligent study by the inventor of the present application, the inventor has found that it is effective to make a plurality of thickness transition regions having different thickness change rates from each other adjacent to each other.

In this structure, since the thickness gradually varies in the thickness transition regions, the durability is high. Furthermore, a degree of freedom in design of the thickness distribution is enhanced by differentiating thickness change rates of the thickness transition regions, and thereby to enable to make a more detailed thickness design. Thus, a detailed thickness design can be achieved corresponding to stress distribution of the face part 4 which is subtly changed by various factors, such as an area Mf1 of the face surface f1, the material of the face surface f1, the shape of the face surface f1, and the like. By consecutively disposing the thickness transition regions, a steep change in thickness is suppressed and a steep change of rebound performance that depends on the thickness is also suppressed. Therefore, stable flight distances, in which differences of flight distances caused by differences in hitting points are small, can be achieved.

In light of optimizing the thickness distribution, two or more thickness transition regions adjacent to each other are preferably disposed between the first constant region S1 and the second constant region S2. Furthermore, three thickness transition regions R1, R2 and R3 adjacent to one another is preferably disposed between the first constant region S1 and the second constant region S2.

In the present application, the thickness of the first constant region S1 is defined as TS1 (mm), and the thickness of the second constant region S2 is defined as TS2 (mm). In light of compatibility between durability and rebound performance, TS2/TS1 is preferably equal to or less than 0.6, more preferably equal to or less than 0.55, and still more preferably equal to or less than 0.5. In light of compatibility between durability and rebound performance, it is not preferable that TS2/TS1 is excessively small. In this respect, TS2/TS1 is preferably equal to or greater than 0.3, more preferably equal to or greater than 0.4, and still more preferably equal to or greater than 0.45.

In light of durability, the thickness TS1 of the first constant region S1 is preferably equal to or greater than 3 mm, more preferably equal to or greater than 3.1 mm, still more preferably equal to or greater than 3.2 mm, and yet still more preferably equal to or greater than 3.35 mm. In the embodiment of FIG. 1, the thickness TS1 is 3.4 mm.

In light of rebound performance, the thickness TS1 of the first constant region S1 is preferably equal to or less than 4 mm, more preferably equal to or less than 3.8 mm, still more preferably equal to or less than 3.7 mm, and yet still more preferably equal to or less than 3.65 mm.

In light of rebound performance, the thickness TS2 of the second constant region S2 is preferably equal to or less than 2.2 mm, more preferably equal to or less than 2 mm, still more preferably equal to or less than 1.9 mm, and yet still more preferably equal to or less than 1.85 mm. In the embodiment of FIG. 1, the thickness TS2 of the second constant region S2 is 1.8 mm. That is, the thickness of the toe-side constant region S2*t* is 1.8 mm, and the thickness of the heel-side constant region S2*h* is 1.8 mm.

In the present application, an area of the first constant region S1 is defined as MS1 ($mm^2$), an area of the second constant region S2 is defined as MS2 ($mm^2$), and an entire area of the face surface f1 is defined as Mf1 ($mm^2$). In the embodiment of FIG. 1, the area MS2 is the sum of areas of the toe-side constant region S2*t* and the heel-side constant region S2*h*.

In light of rebound performance, MS1/Mf1 is preferably equal to or less than 0.2, more preferably equal to or less than 0.15, and still more preferably equal to or less than 0.12. In light of durability, MS1/Mf1 is preferably equal to or greater than 0.05, more preferably equal to or greater than 0.07, and still more preferably equal to or greater than 0.08.

In light of rebound performance, MS2/Mf1 is equal to or greater than 0.08, more preferably equal to or greater than 0.10, and still more preferably equal to or greater than 0.12. In light of durability, MS2/Mf1 is preferably equal to or less than 0.5, more preferably equal to or less than 0.45, and still more preferably equal to or less than 0.4.

In light of rebound performance, the area MS1 is preferably equal to or less than 800 $mm^2$, more preferably equal to or less than 600 $mm^2$, and still more preferably equal to or less than 400 $mm^2$. In light of durability, the area MS1 is preferably equal to or greater than 40 $mm^2$, more preferably equal to or greater than 60 $mm^2$, and still more preferably equal to or greater than 80 $mm^2$.

In light of rebound performance, the area MS2 is preferably equal to or greater than 320 $mm^2$, more preferably equal to or greater than 400 $mm^2$, and still more preferably equal to or greater than 480 $mm^2$. In light of durability, the area MS2 is preferably equal to or less than 2000 $mm^2$, more preferably equal to or less than 1800 $mm^2$, and still more preferably equal to or less than 1600 $mm^2$.

In light of rebound performance, the area Mf1 is preferably equal to or greater than 3700 $mm^2$, more preferably equal to or greater than 3800 $mm^2$, and still more preferably equal to or greater than 3900 $mm^2$. In view of the upper limit of the volume of a head as regulated by the rule, the area Mf1 is preferably equal to or less than 5000 $mm^2$, more preferably equal to or less than 4600 $mm^2$, and still more preferably equal to or less than 4400 $mm^2$.

A weight of the face part 4 is defined as Wf1 (g), and the entire area of the face surface f1 is defined as Mf1 ($mm^2$). Wf1/Mf1 is a weight per unit area of the face part 4.

Weight reduction of the face part 4 can achieve weight reduction of the head 2. The weight reduction of the head 2 contributes to improvement in head speed. In addition, since an excess weight is reserved by the weight reduction of the face part 4, the degree of design freedom of the weight distribution of the head 2 is improved. Furthermore, by the detailed thickness design with the above mentioned structure, durability can be enhanced while substantially suppressing an average thickness of the face part 4. From these standpoints, Wf1/Mf1 is preferably equal to or less than 0.0114 ($g/mm^2$), more preferably equal to or less than 0.00113 ($g/mm^2$), and still more preferably equal to or less than 0.00112 ($g/mm^2$). In light of durability, Wf1/Mf1 is preferably equal to or greater than 0.001 ($g/mm^2$), more preferably equal to or greater than 0.00105 ($g/mm^2$), and still more preferably equal to or greater than 0.0011 ($g/mm^2$).

The above structure can enhance rebound performance while reducing the face weight Wf1. In this respect, Wf1 is preferably equal to or less than 48.5 (g), more preferably equal to or less than 48 (g), and still more preferably equal to or less than 47.5 (g). In light of durability, Wf1 is preferably equal to or greater than 44 (g), more preferably equal to or greater than 44.5 (g), and still more preferably equal to or greater than 45 (g).

The material of the face part 4 is not limited. Examples of the material of the face part 4 include a metal and a composite material. Examples of the composite material include CFRP (carbon fiber reinforced plastic). Examples of the metal include one or more kinds of metals selected from pure titanium, a titanium alloy, stainless steel, maraging steel, an aluminum alloy, a magnesium alloy, and a tungsten-nickel alloy. Examples of the stainless steel include SUS630 and SUS304. Specific examples of the stainless steel include CUSTOM450 (manufactured by Carpenter Technology Corporation). Examples of the titanium alloy include an α-titanium, an αβ-titanium, and a β-titanium. Examples of the α-titanium include Ti-5Al-2.5Sn and Ti-8Al-1V-1Mo. Examples of the αβ-titanium include Ti-6Al-4V, Ti-6Al-2Sn-4Zr-6Mo, Ti-6Al-6V-2Sn, and Ti-4.5Al-3V-2Fe-2Mo. Examples of the β-titanium include Ti-15V-3Cr-3Sn-3Al, Ti-20V-4Al-1Sn, Ti-22V-4Al, Ti-15Mo-2.7Nb-3Al-0.2Si and Ti-16V-4Sn-3Al-3Nb. As the pure titanium, an industrial pure titanium is exemplified. As the industrial pure titanium, type 1 pure titanium, type 2 pure titanium, type 3 pure titanium, and type 4 pure titanium, which are defined by Japanese Industrial Standards, are exemplified. In light of durability, the titanium alloy is preferred.

The material of the face part 4 may different from materials of parts other than the face part 4. The material of the face part 4 may be the same as materials of parts other than the face part 4. If the face part 4 and parts (head body and the like) other than the face part 4 are separately formed, it is preferable that they can be welded to each other.

The composite material (such as carbon fiber reinforced plastic) is excellent in specific strength. If the material of the face part 4 is a composite material, Wf1/Mf1 can be further decreased. In this case, Wf1/Mf1 is preferably equal to or less than 0.0105 ($g/mm^2$), more preferably equal to or less than 0.0104 ($g/mm^2$), and still more preferably equal to or less than 0.0103 ($g/mm^2$). In light of durability, when the material of the face part 4 is a composite material, Wf1/Mf1 is preferably equal to or greater than 0.009 ($g/mm^2$), more preferably equal to or greater than 0.0093 ($g/mm^2$), and still more preferably equal to or greater than 0.0095 ($g/mm^2$).

The vicinity of the face center Fc is the easiest portion to bend, and hitting is frequently made at a point in the vicinity of the face center Fc. In light of durability, a distance between the center of figure of the first constant region S1 and the face center Fc is preferably small. Specifically, the distance between the center of figure of the first constant region S1 and the face center Fc is preferably equal to or less than 5 mm, more preferably equal to or less than 4 mm, and still more preferably equal to or less than 3 mm. This distance may be 0 mm.

The type of the head is not limited. Examples of the type of the head include a wood type, a hybrid type (utility type), an iron type, a putter type, and the like. The wood type head and the hybrid type head, in which the emphasis is put on flight distance, are preferred, and the wood type head is more preferred. In the same respect, a hollow head is preferred.

Since a head having a great volume tends to have a great area Mf1 of the face surface f1, the present disclosure can effectively be applied to the head. In this respect, the head volume is preferably equal to or greater than 100 $cm^3$, more preferably equal to or greater than 120 $cm^3$, still more preferably equal to or greater than 150 $cm^3$, still more preferably equal to or greater than 200 $cm^3$, still more preferably equal to or greater than 300 $cm^3$, still more preferably equal to or greater than 400 $cm^3$, and yet still more preferably equal to or greater than 420 $cm^3$. In light of the rule, the head volume is preferably equal to or less than 470 $cm^3$.

In light of strength, the head weight of preferably equal to or greater than 175 g, more preferably equal to or greater than 180 g, and still more preferably equal to or greater than 185 g. The weight reduction of the head is achieved by lightness of the face part 4. In this respect, particularly in a head of a number 1 wood, the head weight is preferably equal to or less than 200 g, more preferably equal to or less than 195 g, and still more preferably equal to or less than 190 g.

A preferable example of the head is a driver head. The driver means a number 1 wood (W#1). Since the driver has a great area Mf1 of the face part 4, the present disclosure is preferably applied. Usually, the driver head has the following constitutions:

(1a) curved face surface (face surface including a face bulge and a face roll);

(1b) hollow part;

(1c) volume of 300 cc or greater but 460 cc or less; and (1d) real loft of 7 degrees or greater but 14 degrees or less.

Another preferable example of the head is a fairway wood head. The fairway wood head also has a relatively great area Mf1. Examples of the fairway wood include a number 3 wood (W#3), a number 4 wood (W#4), a number 5 wood (W#5), a number 7 wood (W#7), a number 9 wood (W#9), a number 11 wood (W#11), and a number 13 wood (W#13). Usually, the fairway wood head has the following constitutions:

(2a) curved face surface (face surface including a face bulge and a face roll);

(2b) hollow part;

(2c) volume of 100 cc or greater but less than 300 cc; and (2d) real loft of greater than 14 degrees but 33 degrees or less.

More preferably, the volume of the fairway wood head is 100 cc or greater but 200 cc or less.

Still another preferable example of the head is a utility type head (hybrid type head). The utility type head also has a relatively great area Mf1. Usually, the utility type head (hybrid type head) has the following constitutions:

(3a) curved face surface (face surface including a face bulge and a face roll);

(3b) hollow part;

(3c) volume of 100 cc or greater but 200 cc or less; and (3d) real loft of 15 degrees or greater but 33 degrees or less.

More preferably, the volume of the utility type head (hybrid type head) is 100 cc or greater but 150 cc or less.

The present disclosure can be preferably used also for an iron head having a hollow structure. The present disclosure can be preferably used also for a putter head having a hollow structure.

The present disclosure can be applied to all golf club heads such as wood type, utility type, hybrid type, iron type, and putter type golf club heads.

The above descriptions are merely illustrative examples and various changes can be made without departing from the principles of the present disclosure.

What is claimed is:

1. A golf club head comprising a face part, wherein the face part includes a plurality of constant thickness regions and a plurality of thickness transition regions, the constant thickness regions include a first constant region and a second constant region that is thinner than the first constant region, the thickness transition regions are adjacent to each other, are disposed between the first and second constant regions, and include a first transition region and a second transition that is located outside the first transition region, and the first and second thickness transition regions have thickness change rates different from each other.

2. The golf club head according to claim 1, wherein the thickness transition regions have a thickness that decreases toward the second constant region from the first constant region.

3. The golf club head according to claim 1, wherein the first constant region thickness is largest among those of the constant thickness regions.

4. The golf club head according to claim 1, wherein the first constant region includes a face center.

5. The golf club head according to claim 1, wherein when the first constant region thickness is defined as TS1 (mm), and a the second constant region thickness is defined as TS2 (mm), TS2/TS1 is equal to or less than 0.6.

6. The golf club head according to claim 1, wherein when the first constant region area is defined as MS1 ($mm^2$), the second constant region area is defined as MS2 ($mm^2$), and an entire area of a face surface that forms an outer surface of the face part is defined as Mf1 ($mm^2$), MS1/Mf1 is equal to or less than 0.20, and MS2/Mf1 is equal to or greater than 0.08.

7. The golf club head according to claim 1, wherein when the face part weight is defined as Wf1 (g), and an entire area of a face surface that forms an outer surface of the face part is defined as Mf1 ($mm^2$), Wf1/Mf1 is equal to or less than 0.0112 ($g/mm^2$).

8. The golf club head according to claim 7, wherein the face part is formed by a composite material, and Wf1/Mf1 is equal to or less than 0.0105 ($g/mm^2$).

9. The golf club head according to claim 1, wherein the second constant region includes a toe-side constant region and a heel-side constant region, the toe-side constant region is positioned on a toe side relative to the first constant region, the heel-side constant region is positioned on a heel side relative to the first constant region.

10. The golf club head according to claim 1, wherein the second constant region includes a toe-side constant region and a heel-side constant region, a center of figure of the toe-side constant region is positioned on an upper side relative to a center of figure of the heel-side constant region.

11. The golf club head according to claim 1, wherein the second constant region includes a toe-side constant region and a heel-side constant region, a center of figure of the toe-side constant region is positioned on an upper side relative to a face center.

12. The golf club head according to claim 1, wherein the second constant region includes a toe-side constant region and a heel-side constant region, a center of figure of the heel-side constant region is positioned on a lower side relative to a face center.

13. The golf club head according to claim 1, wherein the first constant region is a thickest portion of the face part.

14. The golf club head according to claim 1, wherein the second constant region is a thinnest portion of the face part.

15. The golf club head according to claim 1, wherein the number of the thickness transition regions which are adjacent to each other and disposed between the first constant region and the second constant region is three.

16. A golf club head comprising a face part, wherein the face part includes a plurality of constant thickness regions and a plurality of thickness transition regions, the constant thickness regions include a first constant region and a second constant region that is thinner than the first constant region, the thickness transition regions are adjacent to each other and are disposed between the first and second constant regions, the thickness transition regions have thickness change rates different from each other, and first constant region thickness is defined as TS1 (mm), the second constant region thickness is defined as TS2 (mm), and TS2/TS1 is equal to or less than 0.6.

17. A golf club head comprising a face part, wherein the face part includes a plurality of constant thickness regions and a plurality of thickness transition regions, the constant thickness regions include a first constant region and a second constant region that is thinner than the first constant region, the thickness transition regions are adjacent to each other and are disposed between the first and second constant regions, the thickness transition regions have thickness change rates different from each other, and when an first constant region area is defined as MS1 ($mm^2$), the second constant region area is defined as MS2 ($mm^2$), and an entire area of a face surface that forms an outer surface of the face part is defined as Mf1 ($mm^2$), MS1/Mf1 is equal to or less than 0.20, and MS2/Mf1 is equal to or greater than 0.08.

18. A golf club head comprising a face part, wherein the face part includes a plurality of constant thickness regions and a plurality of thickness transition regions, the constant thickness regions include a first constant region and a second constant region that is thinner than the first constant region, the thickness transition regions are adjacent to each other and are disposed between the first and second constant regions, the thickness transition regions have thickness change rates different from each other, and when the face part weight is defined as Wf1 (g), and an entire area of a face surface that forms an outer surface of the face part is defined as Mf1 ($mm^2$), Wf1/Mf1 is equal to or less than 0.0112 ($g/mm^2$).

19. A golf club head comprising a face part, wherein the face part includes a plurality of constant thickness regions and a plurality of thickness transition regions, the constant thickness regions include a first constant region and a second constant region that is thinner than the first constant region, the thickness transition regions are adjacent to each other and are disposed between the first and second constant regions, the thickness transition regions have thickness change rates different from each other, and there are three thickness transition regions which are adjacent to each other and disposed between the first and second constant regions.

* * * * *